United States Patent [19]

Micallef

[11] Patent Number: 4,826,052

[45] Date of Patent: May 2, 1989

[54] TRIGGER PUMP

[75] Inventor: Lewis A. Micallef, Fort Lee, N.J.

[73] Assignee: Leeds and Micallef, Fort Lee, N.J.

[21] Appl. No.: 70,330

[22] Filed: Jul. 6, 1987

[51] Int. Cl.[4] ..... B65D 88/54

[52] U.S. Cl. ..... 222/321; 222/341; 222/372; 222/383; 239/333

[58] Field of Search ..... 222/340, 341, 320, 321, 222/383, 372, 380; 239/333

[56] References Cited

U.S. PATENT DOCUMENTS

| | | | |
|---|---|---|---|
| 3,179,306 | 4/1965 | Corsette | 222/321 |
| 3,927,834 | 12/1975 | Tada | 222/383 X |
| 4,120,430 | 10/1978 | French | 222/383 X |
| 4,286,736 | 9/1981 | Corsette | 222/321 |
| 4,479,593 | 10/1984 | Bundschuh | 222/341 X |
| 4,640,444 | 2/1987 | Bundschuh | 222/383 X |
| 4,646,969 | 3/1987 | Sorm et al. | 222/383 X |

*Primary Examiner*—Joseph J. Rolla
*Assistant Examiner*—Gregory L. Huson
*Attorney, Agent, or Firm*—Kane, Dalsimer, Sullivan, Kurucz, Levy, Eisele and Richard

[57] ABSTRACT

A dispensing pump for dispensing product from a container serves as a container closure. The pump has a cylinder having an inner shell open at its rear end and closed at a forward end and an outer shell surrounding the inner shell and defining a cavity therebetween. A reciprocally mounted piston is in the inner shell and defines a pump chamber therewith. Inlet port means includes a passage in the outer shell for communication the container interior with the pump chamber during the suction stroke to permit product to pass through the inlet port into the cavity and then into the pump chamber. A vent replaces product removed from the container interior into the pump chamber with air. An outlet valve is provided for opening the outlet port during the compression stroke and for closing the outlet port during the suction stroke; and an inlet valve is provided for opening the inlet port during the suction stroke and for closing the inlet port during the compression stroke.

19 Claims, 4 Drawing Sheets

TRIGGER PUMP

BACKGROUND OF THE INVENTION

A need for an improvement in trigger sprayers was clearly established years ago. Then as is the case now, the object was to develop such a sprayer which would cost no more to manufacture than the presently, widely used trigger sprayers. A further object was to develop a trigger pump which would at least have some of the following characteristics:

(a) a more forceful spray
(b) greater output per stroke
(c) instant priming
(d) flexibility as to volume dispensed without major molding tool changes
(e) ability to generate a foam, mist, spray and stream, if necessary.

Many trigger pumps have been proposed in patents, literature and to a lesser extent commercially. All are not complete in satisfying all commercial needs and applications. To this end, trigger pumps that are not restricted to product to be dispensed have been extremely costly. Those trigger pumps of reduced cost cannot dispense petroleum based product because of seal degradation. Other trigger pumps simply do not possess eye appeal or sufficient aesthetics to be commercially feasible.

SUMMARY OF THE INVENTION

A principal object to the present invention is to provide a cost effective, reliable trigger actuated piston pump with the foregoing characteristics that permits a full stroke with relatively more leverage but with comfort for high volume delivery at high pressure without concern over product compatability.

An important object is to provide a trigger actuated pump of relatively small size with performance characteristics comparable to large industrial trigger pumps including high pressure and more volume per stroke while being a shipper as well as being aesthetically pleasing as commercial (household) pumps having smaller volume per stroke of about ½-9/10 cc, Another important object is to provide a trigger pump of the foregoing type which includes a dual concentric cylinder arrangement which permits wide variety of locations of the cylinder and consequently the pump relative to the dip tube and neck of the container.

A further object is to provide a trigger pump of the foregoing type which includes such features as:

(1) A sliding engagement between the trigger and shaft of the piston which reduces turning moments that would cause binding of the piston in the cylinder.
(2) A nozzle moveable with the piston.
(3) A self sealing vent opening at an optimum location.
(4) The ability to change and select trigger leverage.
(5) The ability to utilize either an external spring for biasing the piston to its fully retracted position.
(6) The ability to use the pump itself to seal the container which may then be a shipper without extra caps or seals.

DETAILED DESCRIPTION

Figure 1:
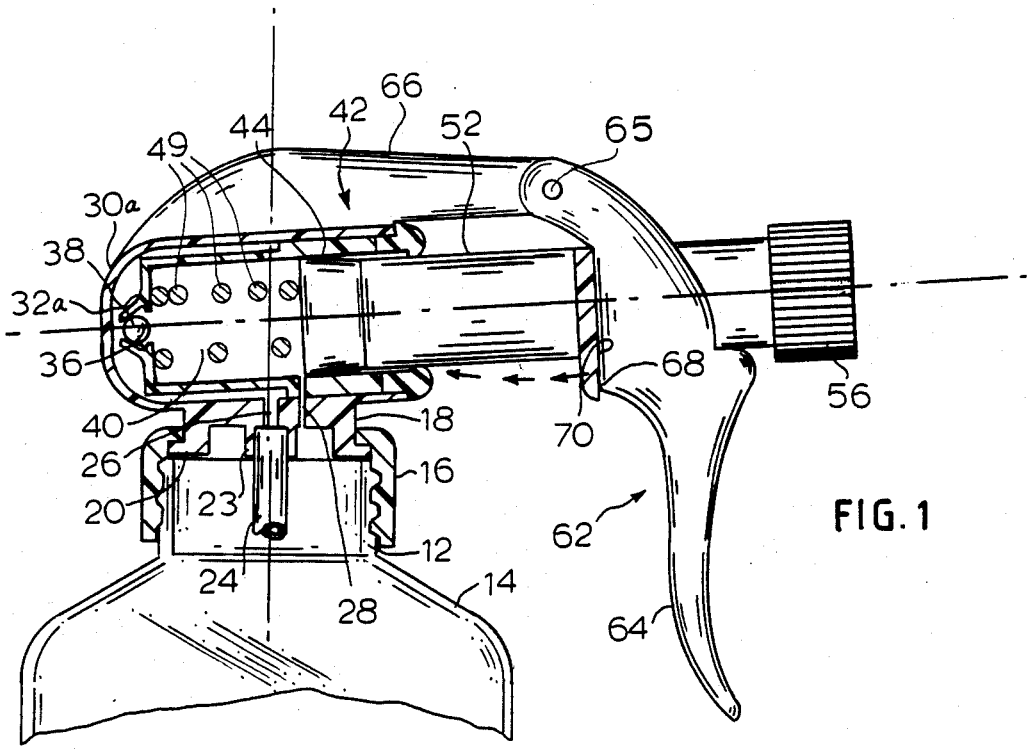
FIG. 1 is a side elevational view of the trigger actuated pump of this invention at the start of the pressure stroke with certain parts broken away and removed and sectioned shown associated with the top of a bottle shown and its base broken away and removed.

In the drawings, a trigger actuated pump 10 is shown associated with the threaded neck 12 of container or bottle 14 containing the product to be dispensed. Towards this end, an integrally threaded cap 16 extends across the opening of the neck 12 and threadably mates therewith in securing the pump 10 on bottle 14. The cap 16 secures the pump base 18 and seals it across the opening of the neck 12 by engaging the circumferentially extending lip 20. Base 18 includes a downwardly depending boss 22 which supports dip tube 24 the base of which communicates with passage 26 for product flow. The base is also provided with vent opening 28 for cooperating in venting the headspace of the bottle 14.

The pump 10 is provided with an outer shell 30 and a concentric inner shell 32 both supported on base 18 and both having a closed inner end 30*a* and 32*a* respectively. The outer shell 30 and inner shell 32 define a product chamber 34 which communicates with passage 26 for reception of product to be dispensed. The vent opening 28 extends through the inner shell 32 for eventual communcation with the atmosphere as will be described shortly. The inner end 32*a* of inner shell 32 is provided with a valve seat 36 which receives a ball check valve 38 for closing off pump chamber 40 within inner shell 32 and isolating it from the product chamber 34 during the pressure stroke. The valve 38 will open to permit product to enter the pump chamber 40 from the product chamber 34 during the suction stroke. The outer end of the outer shell 30 and inner shell 32 are provided with a retaining ring that retains the spaced concentric relationship of the shell and at the same time cooperate in maintaining the coaxial relationship of the piston 42.

The piston 42 includes an inner flared end 44 defining a sealing lip 46 which forms a sliding seal with the interior of inner shell 32. The inner conical surface of the piston inner end 44 merges with wall 48 and the coaxial bore 50 in the piston rod 52. A piston return spring 49 is biased against wall 48 and inner shell wall 32*a*. It is also contemplated that this spring could be readily externally mounted. The outer end 54 of the piston rod 52 mounts a discharge nozzle 56 and an outlet valve 58 biased against valve seal 60. The nozzle 56 may be of any suitable design to generate the desired discharge patterns. The valve 58 serves to close the bore 50 during the suction stroke and unseats during the pressure stroke.

In order to activate the piston 42, a trigger mechanism 62 is employed. The trigger mechanism 62 includes a trigger 64 suitably pivoted at 65 to the trigger support 66 which may be integral with the outer shell 30. Trigger 64 is provided with an actuation surface 68 designed to engage piston actuator plate 70 extending laterally from piston rod 52. The zone of engagement of the trigger surface 68 and the plate 70 is of a sliding nature to provide as near as possible, a direction of force parallel to the axis of the piston rod 52 as the trigger 64 is pulled and the piston 42 is moved axially from its retracted position to its forward position during the pressure stroke.

Figure 2:
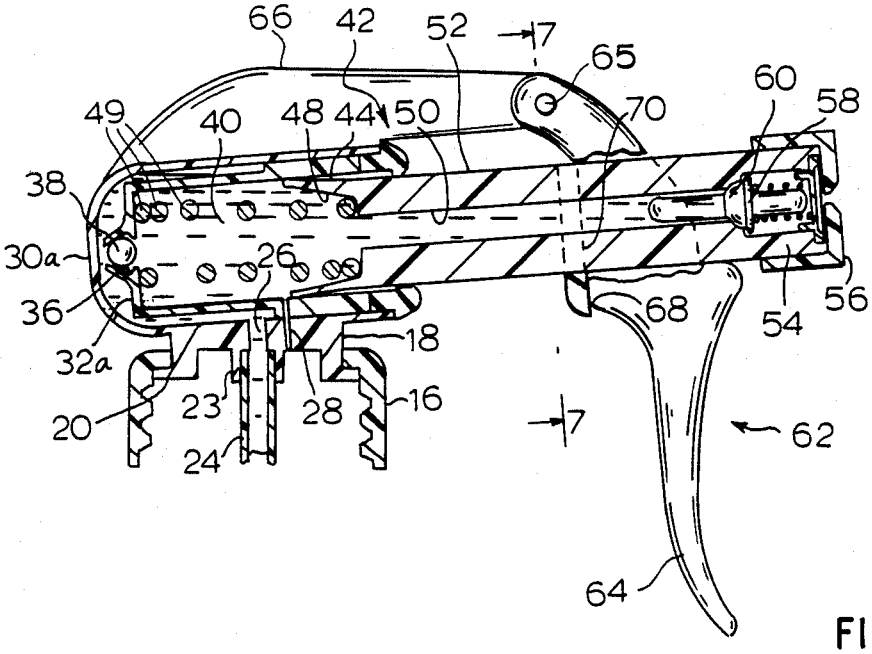
FIG. 2 is a similar view with the piston also sectioned.
Figure 3:
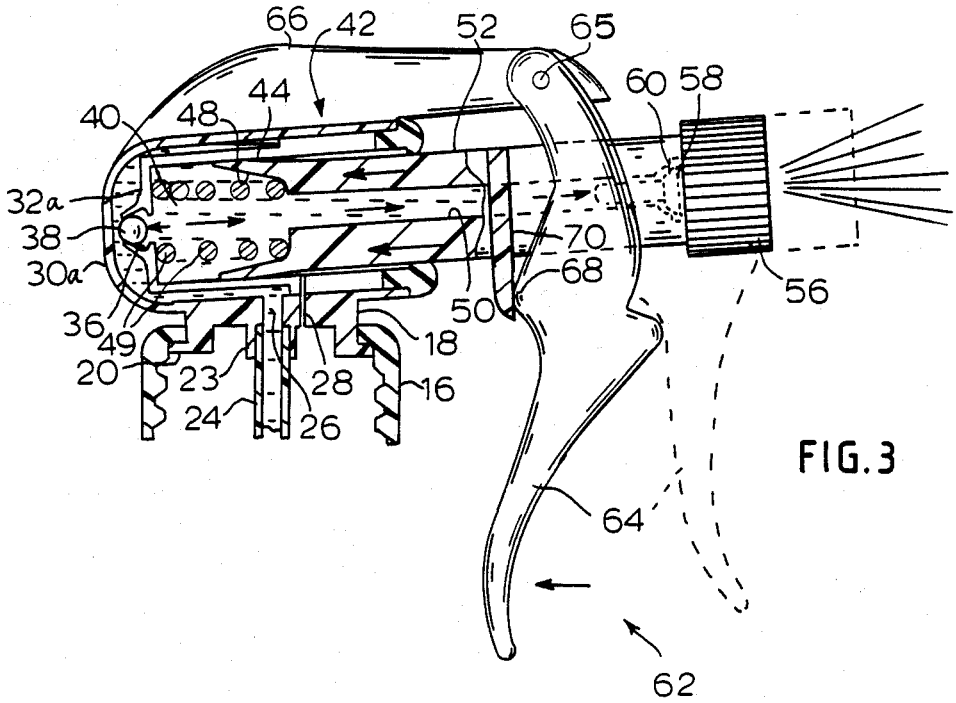
FIG. 3 is a similar view during the pressure stroke and the bottle headspace vented with product being dispensed from the pump chamber.
Figure 4:
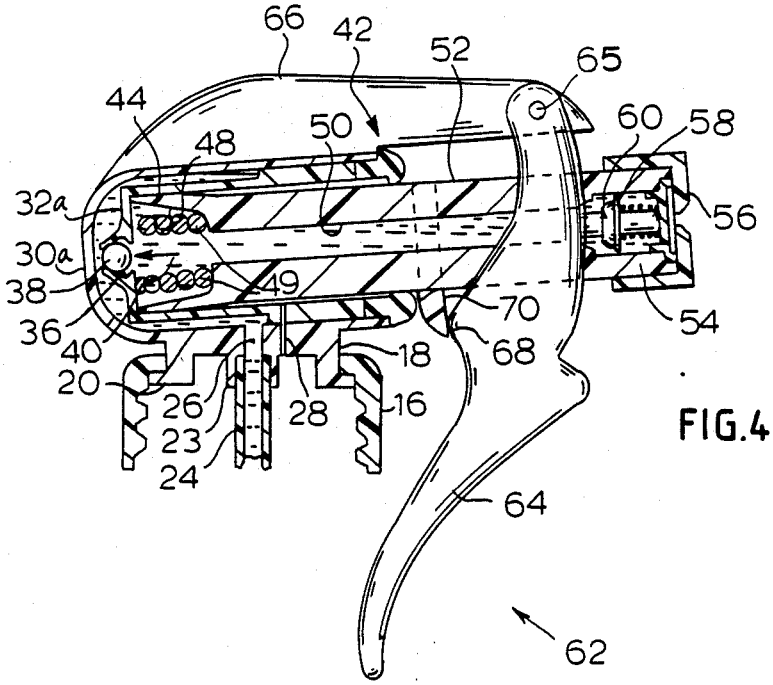
FIG. 4 is a similar view at the end of the pumping angle and start of the suction stroke.

In operation of the pump 10, it will be assumed that initially, the pump will be fully primed with product to be dispensed in chamber 40 and the piston 42 in its fully retracted position as shown in FIGS. 1 and 2. In this position, which is also the end of the suction stroke or start of the pressure stroke, ball 38 will be sealed against seal 36, vent 28 will be closed to the atmosphere and valve 58 will be biased against seal 60. In order to dispense product, the trigger 64 will be pulled and the sliding area 68 of engagement with the plate 70 will force the piston rod 52, and, consequently, piston flared inner end 44 forwardly. This movement will initiate the pressure stroke with the product being forced out of the chamber 40, through bore 50 passed now opened valve 58 out through the nozzle 56 in the desired discharge pattern onto the selected surface. As the trigger 64 is pulled further to the position shown in FIG. 3 the area of engagement 68 with plate 70 will slide or shift upwardly while still exerting a longitudinal force to eventually cause the piston flared inner end 44 to bottom as shown in FIG. 4. It will be noted that during this movement, the vent passage 28 will be opened to vent the container headspace to atmosphere to replace product dispensed with air.

Figure 5:
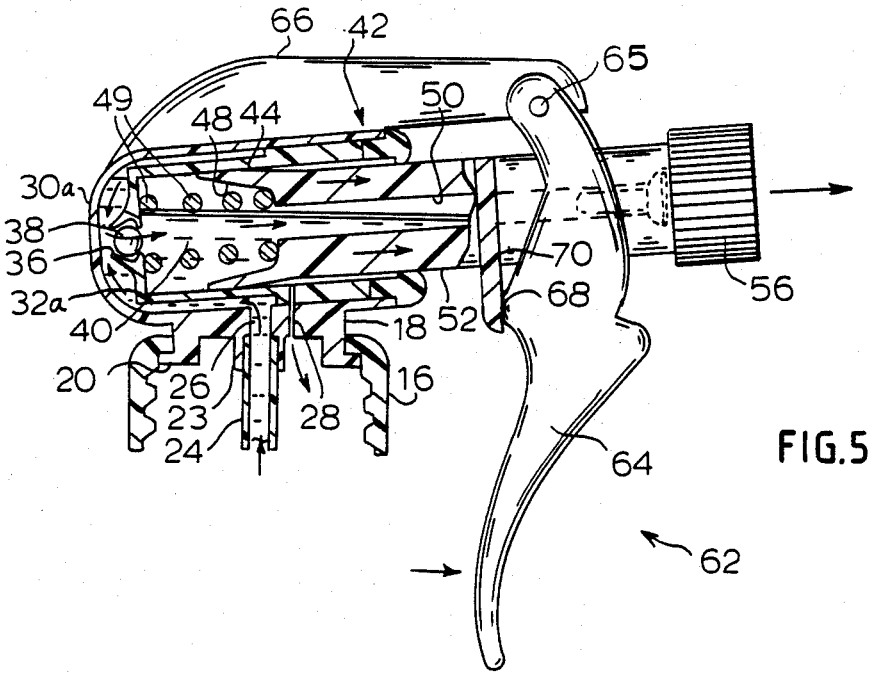
FIG. 5 is a similar view during the suction stroke with product drawn into the pump chamber.
Figure 6:
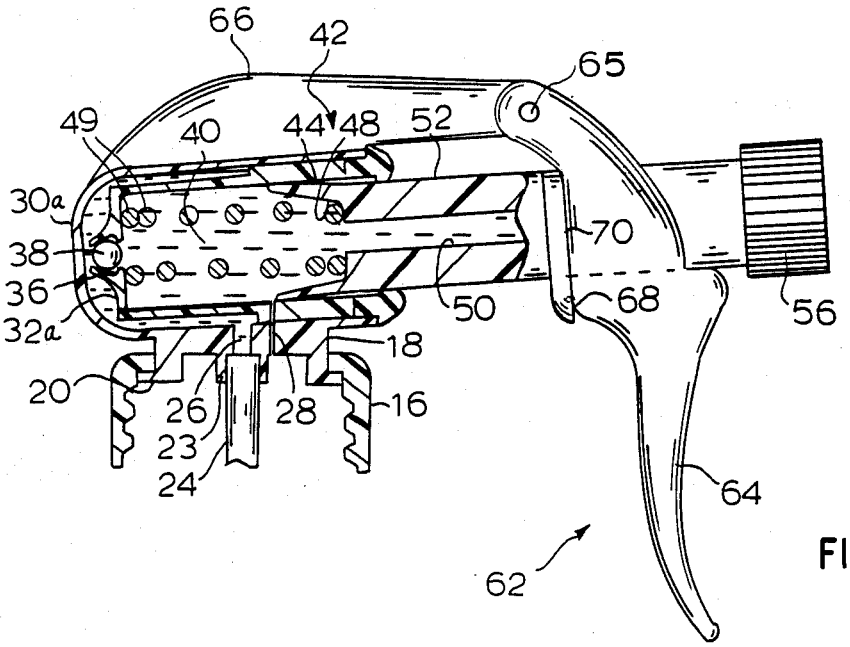
FIG. 6 is a similar view of the end of the suction stroke and start of the pressure stroke.

At the start of the suction stroke, the trigger mechanism 62 is released, spring 49 biased against inner shell wall 32*a* and wall 48, will urge the piston 42 to its retracted position. The outlet valve 58 will close against its seal 69 and inlet valve 38 will open. Product in the container 14 will be forced up dip tube 24 into passage 26 and chamber 34 passed the valve 38 into pump chamber 40 as depicted in FIG. 5. Eventually, the piston 42 will approach its fully retracted position at which product will be pulled into chamber 40 and the headspace will still be vented by open passage 28 as shown in FIG. 6; and then to its fully retracted position of FIGS. 1 and 2 with the vent 28 closed. The pump 10 is now ready for another pressure stroke.

Figure 8:
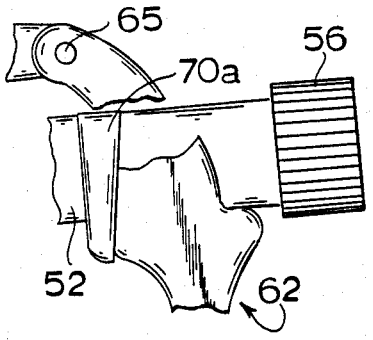
FIG. 8 is a fragmentary sectional view of an alternate embodiment of actuator plate.
Figure 7:
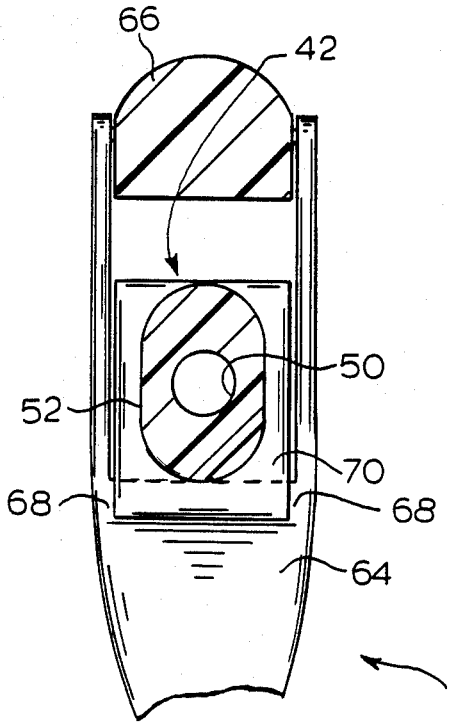
FIG. 7 is a cross sectional view taken along line 7—7 of FIG. 2.

Referring to FIG. 8, an alternate but exemplary embodiment is shown of actuator plate 70*a* which extends from the piston rod 52. Plate 70*a* is beveled or inclined upwardly and rearwardly and with this configuration acts as an accelerator when engaged by actuation surface 68 to provide for a more forceful spray. Obviously other configurations of plate are envisioned which will provide the desired or ultimate of discharge pattern eminating from the nozzle 56.

Figure 9A:
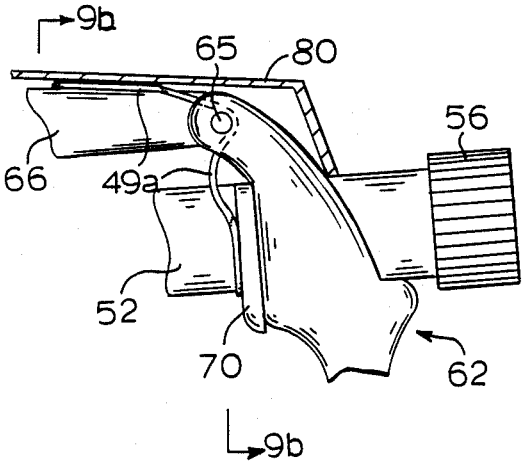
FIGS. 9*a* and 9*b* are fragmentary sectional view showing an alternate form of return spring.
Figure 9B:
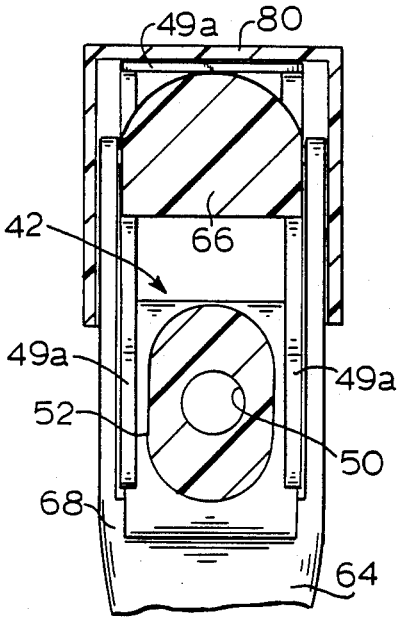

In FIGS. 9*a* and 9*b*, the trigger assembly 62 is shown associated with a return spring 49*a*. This spring is biased against plate 70 and a stationary wall which would be part of the support 66 or an outer shroud 80 thereby cooperating in returning the piston to its retracted position.

Thus, the pump disclosed is of the type in which the piston, piston tube and nozzle move as a unit. Industrial pumps are available today using the same principle. Their use is limited because the long arc thru which the piston must travel in order not to greatly defect the piston and piston tube from the long axis, thereby forcing the nozzle end of the tube to be the highest point on the pump. That part of the trigger which bears against the piston tube is normally in the form of a trunnion and socket, forming a rigid connection from pivot to pivot. This is undesirable because of the turning moments that are generated.

In order to nullify this and other disadvantages the pump body is designed with an inner and outer shell. This allows the pump to be mounted at the optimum point (i.e. above the center line of the bottle). The highest point is now directly above the center line of the bottle, hence, it can be used as a shipper. When a vacuum draws liquid up the dip tube, it travels rearward between the inner and outer shell to the tail, thence past the check ball and into the cylinder headspace. This dual arrangement contributes to the optimum location of the pump or the bottle.

The piston, piston tube and nozzle move as a unit as stated. They are actuated on the pressure stroke by a trigger, part of which slidingly bears against an actuator plate, this allows the point of engagement to move thru an arc without deflecting the piston tube from its longitudinal axis thereby avoiding any undesirable turning moments.

A further important feature is that the distance from the pivot to the point of engagement can be varied in manufacture to provide for smaller or greater output and/or leverage. This is important if a pump with a large diameter is needed. It takes greater energy to move a large diameter piston under load and is tiring to the user. Since only the trigger need be changed much expense is spared.

A self-sealing vent is provided in all embodiments of trigger pump according to the present invention. The pump also lends itself to the use of an external spring, which would be less expensive, it could be located from the pivot to a point behind the actuator plate, and could be of the double hairpin design.

Accordingly, the foregoing pump characteristics, objects and advantages are more effectively attained. The pump of the invention provides:

(1) higher adjustable pump pressure
(2) longer adjustable trigger stroke
(3) greater adjustable pump volume
(4) vent that is sealable directly to the chamber
(5) adjustable trigger leverage
(6) adjustable pump chamber diameter
(7) No pump leakage
(8) pump centered on neck of container
(9) ability to use a shroud over pump if desired.

Thus, the several aforenoted objects and advantages are most effectively attained. Although a single somewhat preferred embodiment has been disclosed and described in detail herein, it should be understood that this invention is in no sense limited thereby and its scope is to be determined by that of the appended claims.

I claim:

1. A high volume, high pressure dispensing pump for dispensing product from a container, the pump serving as a container closure comprising:

a cylinder comprising an inner shell having a forward and rearward end said inner shell being open at its rear end and closed at its forward end; an outer shell surrounding the inner shell and defining a cavity therebetween for receiving product to be dispensed, the dual concentric shell arrangement permitting a wide variety of location of the pump relative to the container neck, the inner and outer shells being concentric tubular members connected substantially at their respective open rear ends;

a piston having a forward and rear end and being reciprocally mounted in the inner shell and defining a pump chamber therewith, and the piston being relatively reciprocal through a pressure stroke from an extended position to an inserted position and through a suction stroke from an inserted position to the extended position;

inlet port means including inlet port at the forward end of the inner shell and a passage in the outer shell for cooperating in communicating the container interior with the pump chamber during the suction stroke to permit product to pass through the passage into the cavity, forwardly through the cavity through the inlet port and then into the pump chamber, a pump base extending outwardly from the outer shell and including the passsage and a cap means coupled with the base for coupling the pump to the neck of the container;

outlet port means for product to be dispensed under pressure from the pump chamber during compression stroke;

venting means for replacing product removed from the container interior into the pump chamber with air, the vent means includes a passageway through the cylinder, outershell, and pump base that communicates the interior of the container with the atmosphere during the reciprocation of the piston and the passageway is adapted to be sealed from the atmosphere by the piston when the piston is in a fully extended position;

outlet valve means for opening the outlet port means during the compression stroke and for closing the outlet port means during the suction stroke; and inlet valve means at the inlet port for opening the inlet port disposed at the forward end of the inner shell during the suction stroke and for closing the inlet port during the compression stroke, the forward end of the inner shell including a central opening communicating the pump chamber with the cavity, the inlet valve means including a valve seat surrounding the inner shell opening and a ball coupled with the seat for opening and closing the inner shell opening.

2. The invention in accordance with claim 1 wherein the passage of the inlet port means is adapted to be substantially coaxially located with the neck of the container.

3. The invention in accordance with claim 2 wherein a dip tube is coupled with the passage.

4. The invention in accordance with claim 1 wherein the piston includes a longitudinally extending bore forming part of the outlet port means and communicating the pump chamber with the ambient and the outlet valve means extending across the bore.

5. The invention in accordance with claim 4 wherein a nozzle is coupled with the rear end of the piston for directing the product in a predetermined spray pattern as it emerges from the outlet valve means.

6. The invention in accordance with claim 1 wherein biasing means urges the piston towards its extended position and the bias is adopted to be overcome by pulling the trigger upon digital engagement of the trigger lower end.

7. The invention in accordance with claim 6 wherein the biasing means is a spring extending between the inner end of the inner shell and forward end of the piston.

8. The invention in accordance with claim 1 wherein a trigger mechanism is coupled with the piston for reciprocating the piston between the extended and inserted position.

9. The invention in accordance with claim 8 wherein the trigger mechanism include a trigger having an upper and lower end, pivot means pivotally connecting the upper end of the trigger to an upper extension of the outer shell, a finger engaging surface on the lower end of the trigger for digital engagement, a piston actuation means on the piston intermediate the piston ends for sliding engagement with the trigger to thereby minimize turning movements on the piston as it is reciprocated by movement of the trigger when the trigger is digitally engaged at its lower end to pivot the trigger about the pivot means.

10. The invention in accordance with claim 9 wherein the passageway extends through the outer and inner shells.

11. The invention in accordance with claim 9 wherein the piston actuator means is a laterally extending plate engaged by the trigger.

12. The invention in accordance with claim 11 wherein biasing means urges the piston towards its extended position and the bias is adopted to be overcome by pulling the trigger upon digital engagement of the trigger lower end.

13. The invention in accordance with claim 12 wherein the biasing means is a spring extending between the forward end of the inner shell and forward end of the piston.

14. The invention in accordance with claim 11 wherein said trigger mechanism has means for slidably engaging said plate which can be preselected to provide a proper trigger leverage, the point of sliding engagement moving through an arc to thereby minimize turning movement on the piston thereby minimizing binding of the piston in the cylinder as it is reciprocated by movement of the trigger when the trigger is digitally engaged at its lower end to pivot the trigger about the pivot means, the trigger applying a direction of force on the piston actuating plate substantially parallel to the axis of the piston as the trigger is pulled.

15. The invention in accordance with claim 14 wherein biasing means urges the piston towards its extended position and the bias is adapted to be overcome by pulling the trigger upon digital engagement of the trigger lower end.

16. The invention in accordance with claim 14 wherein the point of sliding engagement is located below the axis of the piston.

17. The invention in accordance with claim 14 wherein the piston actuating plate is provided with a selected configuration to which in cooperation with the point of engagement of the trigger, which may be preselected acts to vary the discharge pattern of the product to be dispensed.

18. The invention in accordance with claim 14 wherein the piston includes a longitudinally extending bore forming part of the outlet port means and communicating the pump chamber with the ambient and the outlet valve means extending across the bore.

19. The invention in accordance with claim 18 wherein a nozzle is coupled with the rear end of the piston for directing the product in a predetermined spring pattern as it emerges from the outlet valve means.

* * * * *